US011199009B2

(12) United States Patent
Zhu

(10) Patent No.: US 11,199,009 B2
(45) Date of Patent: Dec. 14, 2021

(54) METHOD FOR LAYING WALL CLADDING SHEET

(71) Applicant: Gong Zhu, Xiamen (CN)

(72) Inventor: Gong Zhu, Xiamen (CN)

( * ) Notice: Subject to any disclaimer, the term of this patent is extended or adjusted under 35 U.S.C. 154(b) by 98 days.

(21) Appl. No.: 16/742,810

(22) Filed: Jan. 14, 2020

(65) Prior Publication Data

US 2020/0224428 A1 Jul. 16, 2020

(30) Foreign Application Priority Data

Jan. 14, 2019 (CN) ..... 201910033327.1
Jan. 14, 2019 (CN) ..... 201910033328.6

(51) Int. Cl.
*E04F 13/08* (2006.01)

(52) U.S. Cl.
CPC ..... *E04F 13/0803* (2013.01); *E04F 13/0875* (2013.01)

(58) Field of Classification Search
CPC ..... E04F 13/07; E04F 13/08; E04F 13/0801; E04F 13/0803; E04F 13/0832; E04F 13/0833; E04F 13/0841; E04F 13/086; E04F 13/0866; E04F 13/0875; E04F 13/26; E04F 19/061; E04F 19/062; E04F 19/065; E04F 21/1838; E04F 21/1844
See application file for complete search history.

(56) References Cited

U.S. PATENT DOCUMENTS

| | | | | |
|---|---|---|---|---|
| 3,029,560 | A * | 4/1962 | Benson | E04F 13/0803 52/471 |
| 6,134,847 | A * | 10/2000 | Bifano | E04B 1/765 52/101 |
| 6,470,638 | B1 * | 10/2002 | Larson | E04B 1/765 52/254 |
| 9,783,993 | B2 * | 10/2017 | Gleeson | E04F 13/081 |
| 9,879,419 | B2 * | 1/2018 | Krause | E04F 13/0803 |
| 10,087,616 | B1 * | 10/2018 | Lam | E04B 2/723 |
| 10,174,510 | B2 * | 1/2019 | Silk | E04F 19/049 |
| 10,233,651 | B2 * | 3/2019 | O'Leary | E04F 13/0803 |
| 10,443,229 | B2 * | 10/2019 | Krause | E04B 1/40 |
| 2003/0140588 | A1 * | 7/2003 | Sucato, Jr. | E04F 13/0803 52/506.01 |

(Continued)

FOREIGN PATENT DOCUMENTS

| | | | | |
|---|---|---|---|---|
| FR | 2669957 | A1 * | 6/1992 | E04F 13/0803 |
| FR | 3071264 | A1 * | 3/2019 | E04F 13/0826 |

(Continued)

*Primary Examiner* — Ryan D Kwiecinski

(57) ABSTRACT

A method for laying wall cladding sheet mainly have following steps, placing an auxiliary line, drilling a mounting hole according to the auxiliary line, placing an expansion casing in the mounting hole, placing, adjusting and fastening a first trim strip to the wall, placing a first EPE foam to appress the wall, placing a first wall cladding sheet to appress the first EPE foam, placing and adjusting a second trim strip to fasten the first wall cladding sheet to appress the first EPE form to the wall, placing a second EPE foam to appress the wall, placing a second wall cladding sheet to appress the second EPE foam, placing and adjusting a third trim strip to fasten the second wall cladding sheet to appress the second EPF foam to the wall.

15 Claims, 11 Drawing Sheets

(56) References Cited

U.S. PATENT DOCUMENTS

| | | | | |
|---|---|---|---|---|
| 2008/0104918 | A1* | 5/2008 | Gleeson | E04B 1/762 52/489.1 |
| 2017/0159293 | A1* | 6/2017 | Haley | E04C 3/28 |
| 2017/0247882 | A1* | 8/2017 | Krause | E04F 13/0821 |
| 2021/0108421 | A1* | 4/2021 | Matson | E04F 13/0803 |

FOREIGN PATENT DOCUMENTS

| | | | | |
|---|---|---|---|---|
| KR | 20150033137 | A * | 4/2015 | |
| WO | WO-2020071051 | A1 * | 4/2020 | E04F 13/0883 |

* cited by examiner

METHOD FOR LAYING WALL CLADDING SHEET

CROSS-REFERENCE TO RELATED APPLICATIONS

This application claims priority to China Patent Application No. 201910033327.1, filed Jan. 14, 2019, and also claims priority to China Patent Application No. 201910033328.6, filed Jan. 14, 2019, the disclosures of which are hereby incorporated herein by reference in their entireties.

BACKGROUND OF THE INVENTION

The invention relates to a decoration method, especially to a method for laying wall cladding sheet.

It is usual to firstly level a rough wall with cement mortar in the field of decoration, then putty powder is used as a base, and finally coat the wall with latex paint, such decoration process may have formaldehyde pollution and cause hidden dangers to indoor personnel. Therefore, in order to avoid formaldehyde pollution, wall cladding sheet is used to wall decoration, such as natural marble, or artificial marble, or ceramic tile, or glass, or metal plate. It is necessary to level the rough wall with cement mortar before wall cladding sheets are laid on the wall, the thickness of the cement mortar is about 5 mm. Wall cladding sheets are laid on the levelled wall with cement mortar after levelling process, the thickness of the cement mortar used is about 10 mm. Therefore, the total thickness of the cement mortar is about 15 mm. Decoration adopting cement mortar to paste wall cladding sheets can avoid formaldehyde pollution, but it may greatly increase the thickness of wall and reduce a certain amount of use area in door. Due to the use of cement mortar in laying process, for a period of time after laying of wall cladding sheets, water in the wall slowly evaporates from the wall, such water evaporation may increases the humidity in the room and cause odors in the room. And because it is needed to hit cladding sheets with a rubber hammer to adjust the flatness of cladding sheets in the laying process, hammering sound accompanies the entire laying process and a long period of noise pollution is caused, such hammering noise is uncomfortable for downstairs residents. How to design a decoration that can avoid formaldehyde pollution without greatly increasing the thickness of the wall while reducing noise pollution has become a problem to be solved by the present invention.

BRIEF SUMMARY OF THE INVENTION

The object of the invention is to provide a method for laying wall cladding sheet so as to avoid formaldehyde pollution without greatly increasing the thickness of the wall while reducing noise pollution.

Such object is achieved by providing a method for laying wall cladding sheet as defined in claim 1. Further advantageous according to the invention will be apparent from the dependent claims.

The invention provides a method for laying wall cladding sheet, the method comprises steps:

A1 placing a first auxiliary line on a ground to lay a wall cladding sheet along the first auxiliary line.

A2 placing a second auxiliary line on a wall parallel to the first auxiliary line, the second auxiliary line comprises a plurality of horizontal lines.

A3 placing a third auxiliary line on the wall, the third auxiliary line is vertical and comprises a plurality of vertical lines.

A4 drilling a mounting hole on the wall at an intersection point of the second auxiliary line and the third auxiliary line, placing an expansion casing in the mounting hole to fasten a trim strip.

A5 placing and adjusting a first trim strip to make a first surface of the first trim strip appress the ground and make a second surface of the first trim strip match the wall and make a third surface of the first trim strip appress the first auxiliary line.

A6 placing a first expansion screw to fasten the first trim strip to the wall under a cooperation of the first expansion casing.

A7 placing a first EPE foam to make the first PEP foam appress the wall, a distance between the first EPE foam and the third surface of the first trim strip is less than a thickness of a first wall cladding sheet.

A8 placing the first wall cladding sheet, the first wall cladding sheet is assembled between the third surface of the first trim strip and the first EPE foam in an interference way.

A9 placing and adjusting a second trim strip to make a fourth surface of the second trim strip appress a first surface of the first wall cladding sheet and make a fifth surface of the second trim strip match the wall and make a sixth surface of the second trim strip appress a second surface of the first wall cladding sheet.

A10 placing a second expansion screw to fasten the second trim strip to the wall under a cooperation of a second expansion casing.

All placing a second EPE foam to make the second EPE foam appress the wall, a distance between the second EPE foam and the sixth surface of the second trim strip is less than a thickness of the second wall cladding sheet.

A12 placing the second wall cladding sheet, the second wall cladding sheet being assembled between the sixth surface of the second wall cladding sheet and second EPE foam in an interference way.

A13 placing and adjusting a third trim strip to make a seventh surface of the third trim strip appress a third surface of the second wall cladding sheet and make an eighth surface of the third trim strip match the wall and make a ninth surface of the third trim strip appress a fourth surface of the second wall cladding sheet.

A14 placing a third expansion screw to fasten the third trim strip to the wall under a cooperation of a third expansion casing.

Optionally, step A5 comprises filling a space between the second surface of the first trim strip and the wall with a first backing plate. Step A9 comprises filling a space between the fifth surface of the second trim strip and the wall with a second backing plate. Step A13 comprises filling a space between the eighth surface of the third trim strip and the wall with a third backing plate.

Optionally, a vertical alignment that the second surface of the first wall cladding sheet and the fourth surface of the second wall cladding sheet are on a same vertical plane by adjusting the third backing plate is arranged.

Optionally, the wall cladding sheet comprises a natural stone, or an artificial stone, or a ceramic tile.

Advantageous Effects

The method for laying wall cladding sheet of the present invention have following benefits.

(1) Mechanically tightening ceramic tiles can prevent ceramic tiles from being hollowed out, thereby preventing potential danger of injury caused by ceramic tiles falling down due to the hollowing out.

(2) Because ceramic tiles are completely mechanically fastened during the laying process, there is no water and mortar. Therefore, there is no water dispersion and no moisture indoors.

(3) Since ceramic tiles are completely mechanically fastened during the laying process, no glue is used for bonding. Therefore, no formaldehyde is emitted indoors and no formaldehyde pollution.

(4) Because modular assembly is adopted, wall drilling is unified in early stage, and expansion screws are used in later stage, noise pollution period is extremely short, only existing in the early wall drilling, no noise pollution during the later laying process.

(5) Because the edge of tile is buckled from the front of tile by trim strip, the tile is intact without any cut for groove. Because EPE foam is laid on the back of tile, the tile and the wall are cushioned by EPE foam. Therefore, there is no load concentration point on tile. When the front of tile is hit, impact force is released to the EPE foam through the entire back of tile. The load is balanced and there is no load concentration point, so the tile is not easy to break.

(6) Because wall cladding sheet is fastened with expansion screws, which is a removable assembly method, when the wall needs to be renovated, the wall cladding sheet can be conveniently removed from the wall intact, it is conducive for secondary use to improve the utilization of resources, and to eliminate waste of resources.

(7) Due to the independent bubble structure of EPE foam, the thermal insulation performance and sound insulation performance of wall are improved.

(8) The use of EPE Foam instead of the cement mortar leveling layer and the cement mortar bonding layer on the back of the wall cladding sheet makes the wall thinner and lighter, and reduces the burden on the floor beam.

(9) Since the EPE foam on the back of tile bears the load on the entire back of the tile, the larger the area of a single tile, the smaller the load on the unit area of the EPE foam, and the smaller the deformation of the unit area on the EPE foam. That is, the less likely the tile is to be displaced in the direction of the normal phase of the tile surface.

(10) The hardness of the large tiles laid with EPE foam is as hard as that of large tile bonded with cement mortar after curing, but the weight of the EPE foam is lighter than that of cement mortar.

BRIEF DESCRIPTION OF THE SEVERAL VIEWS OF THE DRAWINGS

Further characteristics and advantages of the invention will emerge from the description of preferred, but not exclusive embodiments of a method for laying wall cladding sheet according to the invention, non-limiting examples of which are provided in the attached drawings, in which.

List of Reference Characters

| | |
|---|---|
| 1. ground; | 2. wall; |
| 3. first auxiliary line; | 4. second auxiliary line; |
| 5. third auxiliary line; | 6. fourth auxiliary line; |
| 10. first trim strip; | 11. first EPE foam; |
| 12. first wall cladding sheet; | 13. first expansion screw; |
| 14. first expansion casing; | 15. first backing plate; |
| 16. first surface; | 17. second surface; |
| 18. third surface; | 20. second trim strip; |
| 21. second EPE foam; | 22. second wall cladding sheet: |
| 23. second expansion screw; | 24. second expansion casing; |
| 25. second backing plate; | 26. fourth surface; |
| 27. fifth surface; | 28. sixth surface; |
| 30. third trim strip; | 33. third expansion screw; |
| 34. third expansion casing; | 35. third backing plate; |
| 36. seventh surface; | 37. eighth surface; |
| 38. ninth surface. | |

DETAILED DESCRIPTION OF THE INVENTION

Embodiment 1

Figure 1:
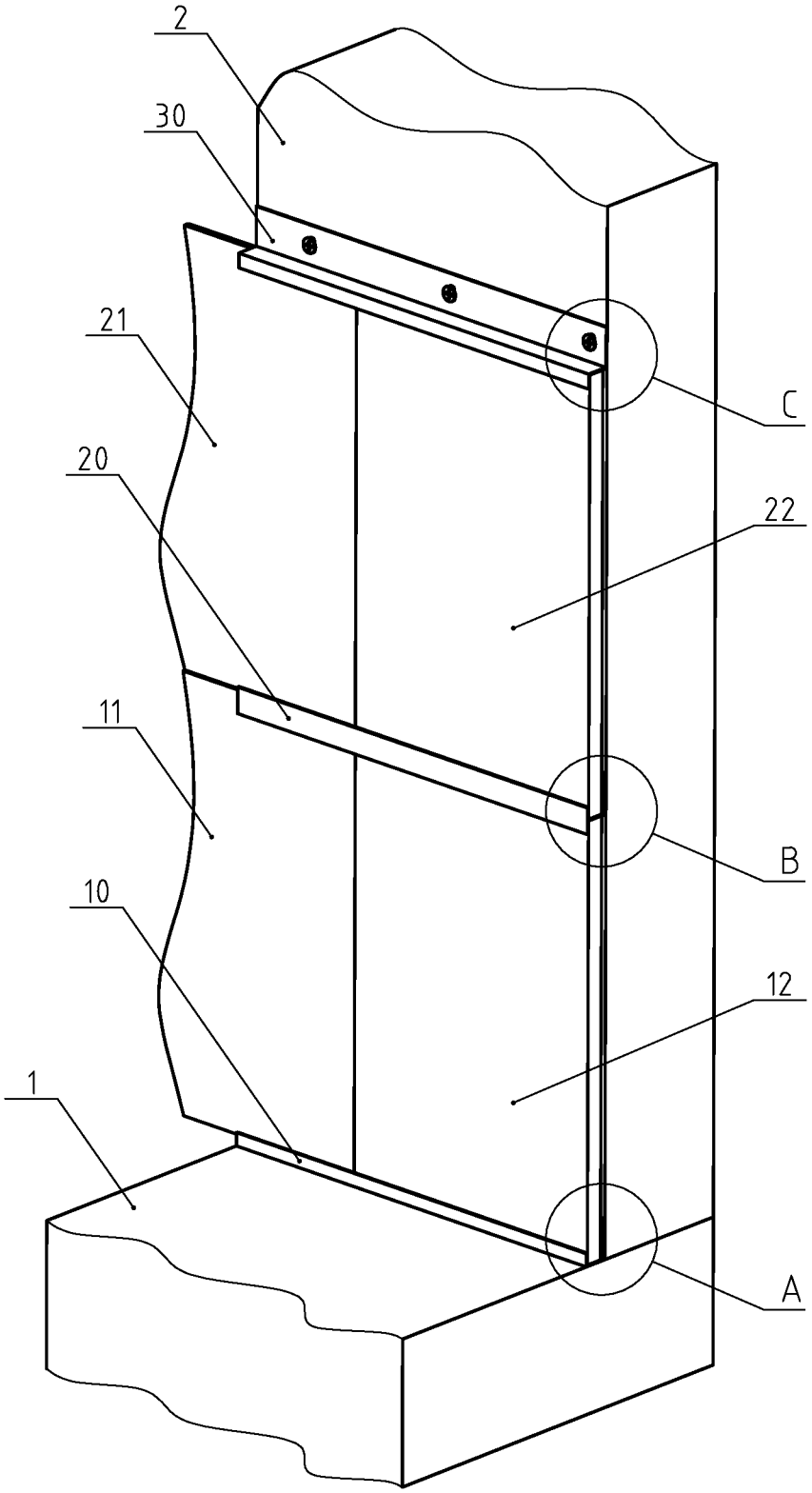
FIG. 1 is a partial perspective view of a laying method in Embodiment 1.

FIG. 1 shows a wall 2 laid with wall cladding sheets by a laying method disclosed by the present invention, a tile is as an example of wall cladding sheets, the dimensions of the tile are 600 mm in width, 1200 mm in height and 11 mm in thickness. A lower edge of a first tile 12 is fixed on the wall 2 by a first trim strip 10, an upper edge of the first tile 12 is fixed on the wall 2 by a second trim strip 20, a first EPE foam 11 is clamped between the first tile 12 and the wall 2. A lower edge of a second tile 22 is fixed on the wall 2 by the second trim strip 20, an upper edge of the second tile 22 is fixed on the wall 2 by a third trim strip 30, a second EPE foam 21 is clamped between the second tile 22 and the wall 2, the EPE foam has an thickness of 11 mm. Embodiment 1 takes laying two rows of tiles as an example, if the number of laying rows is N (N>2), the first tile 12 is fixed by the first trim strip 10 and the second trim strip 20 in first row (near the ground 1), and the second tile 22 is fixed by the second trim strip 20 and the third trim strip 30 in row N (near the ceiling), the trim strip is fastened on the wall 2 by an expansion screw.

Figure 4:
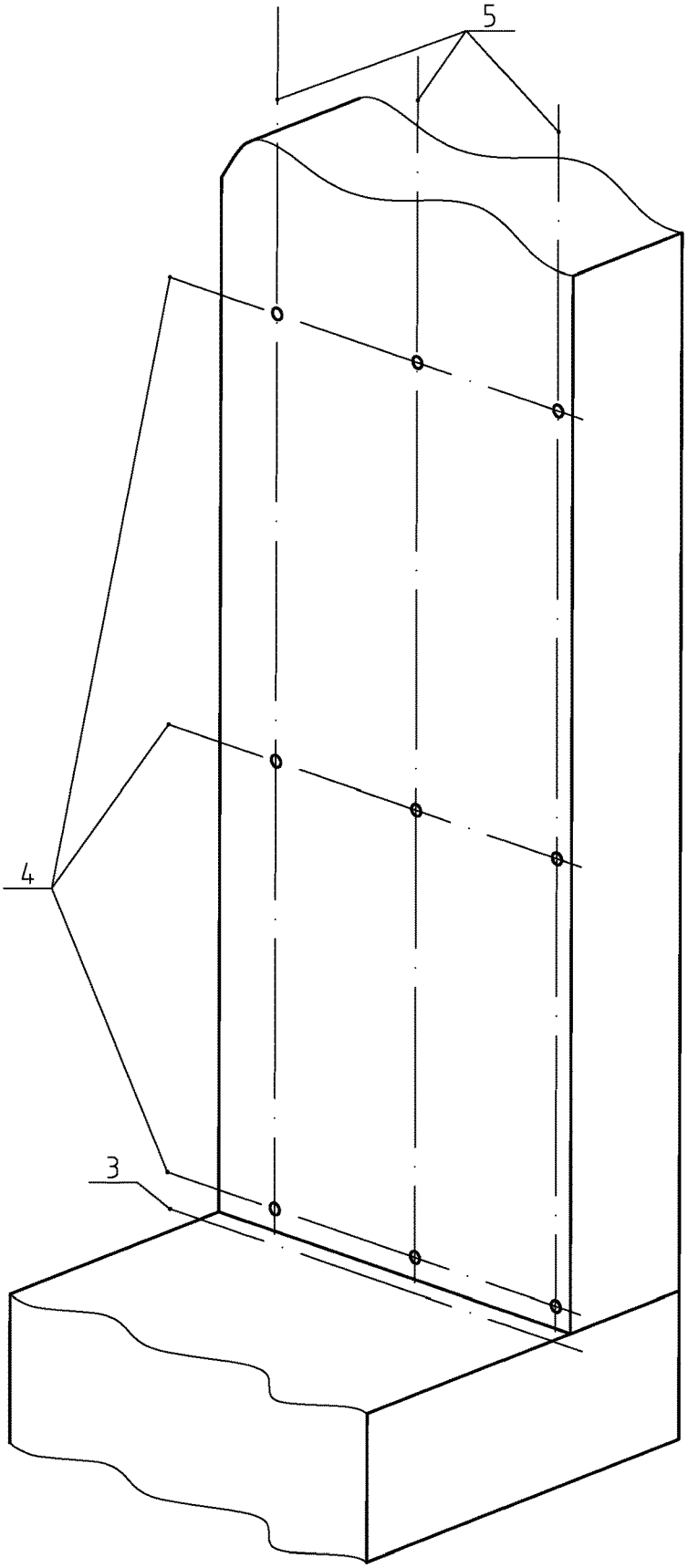
FIG. 4 is a layout of auxiliary line of FIG. 1.

FIG. 4 is a layout of auxiliary line of the present invention, because modular assembly is adopted in the invention, uniform drilling is used in early stage, and unified assembly is used in later stage, there is needed to place auxiliary lines before laying wall cladding sheets. Steps for the laying method are as follows.

A1 placing a first auxiliary line 3 on the ground 1 to lay the tile along the first auxiliary line 3, the first auxiliary line 3 can be placed on the ground 1 in a method of elastic ink line.

A2 placing a second auxiliary line 4 on the wall 2, the second auxiliary line 4 is parallel to the first auxiliary line 3, the second auxiliary line 4 comprises a plurality of horizontal lines, a distance between each horizontal lines is determined a tile height and a material thickness of the trim strip, the distance equals the tile height plus the material thickness of the trim strip, a distance between the second auxiliary line 4 near the ground 1 and the ground 1 is determined by a position of a mounting hole of a first trim strip 10.

A3 placing a third auxiliary line 5 on the wall 2, the third auxiliary line 5 is vertical and comprises a plurality of vertical lines, a distance between each vertical lines is determined by a width of the tile, Embodiment) takes arranging two expansion screws within a width of the tile as an example. At this point, auxiliary line placement steps are completed, and then the mounting hole placement steps are performed.

A4 drilling a mounting hole on the wall 2 at an intersection point of the second auxiliary line 4 and the third auxiliary line 5, placing an expansion casing in the mounting hole to fasten a trim strip. At this point, crisscross mounting holes are arranged on the wall 2, and then tile laying steps are performed.

Figure 3:
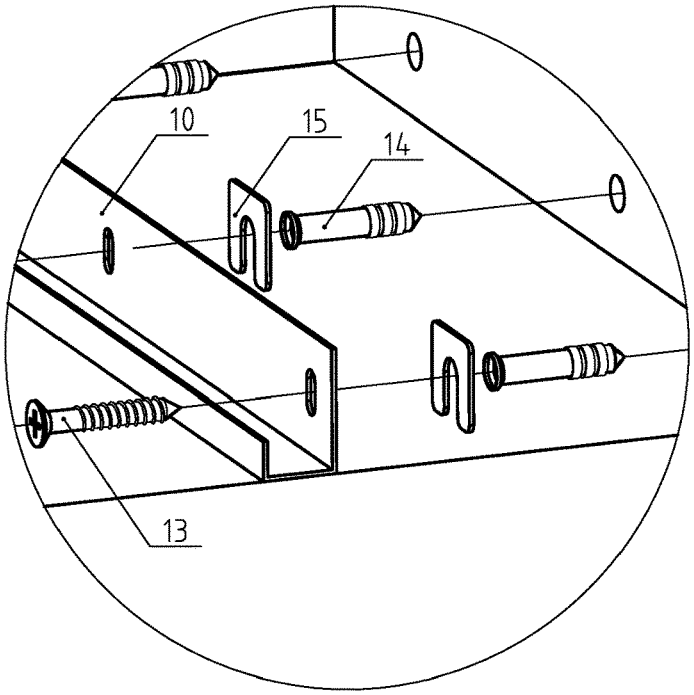
FIG. 3 is a partial view of part D in FIG. 2.

A5 placing and adjusting the first trim strip 10 to make a first surface 16 of the first trim strip 10 appress the ground 1 and make a second surface 17 of the first trim strip 10 match the wall 2 and make a third surface 18 of the first trim strip 10 appress the first auxiliary line 3. The laying method disclosed in the present embodiment can be implemented on a rough wall 2, because the rough wall 2 is unlevelled, there may be a space between the second surface 17 of the first trim strip 10 and the wall 2, the space can be filled by a first backing plate 15, in particular, a space at a mounting hole needs to be filled with the first backing plate 15, an overall thickness can be adjusted by combining multiple first backing plate 15*s* to fill different spaces, as shown in FIG. 3.

A6 placing a first expansion screw 13, the first trim strip 10 is fasten to the wall 2 by a cooperation of the first expansion screw 13 and the first expansion casing 14.

A7 placing a first EPE foam 11, the EPE foam is arranged to appress the wall 2, a distance between the first EPE foam 11 and the third surface 18 of the first trim strip 10 is less than a thickness of a first tile 12 so as to provide a basis for an interference assembly of the first tile 12.

A8 placing the first tile 12, the first tile 12 is assembled between the third surface 18 of the first trim strip 10 and the first EPE foam 11 in an interference way. Insert the first tile 12 diagonally into a space between the first EPE foam 11 and the third surface 18 of the first trim strip 10, and then temporarily fix the first tile 12 at current position with an auxiliary tool.

Figure 2:
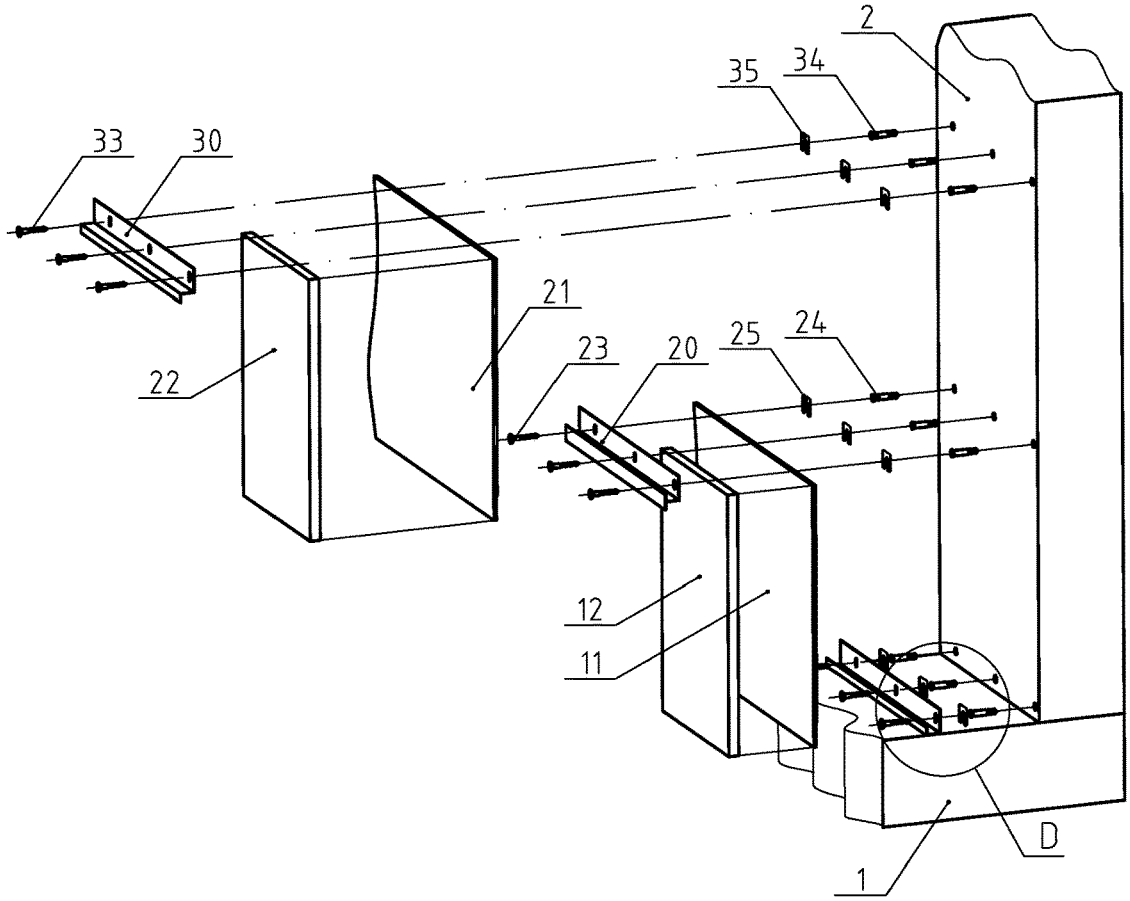
FIG. 2 is an exploded view of FIG. 1.

A9 placing and adjusting a second trim strip 20 to make a fourth surface 26 of the second trim strip 20 appress a first surface 16 of the first tile 12 and make a fifth surface 27 of the second trim strip 20 match the wall 2 and make a sixth surface 28 of the second trim strip 20 appress a second surface 17 of the first tile 12. The first surface 16 of the first tile 12 is defined as a side surface of the first tile 12 facing a ceiling after being assembled, the second surface 17 of the first tile 12 is defined as a front surface of the first tile 12. The laying method disclosed in the present Embodiment can be implemented on a rough wall 2, because the rough wall 2 is unlevelled, there may be a space between the fifth surface 27 of the second trim strip 20 and the wall 2, the space can be filled by a second backing plate 25, in particular, a space at a mounting hole needs to be filled with the second backing plate 25, an overall thickness can be adjusted by combining multiple second backing plate 25*s* to fill different spaces, as shown in FIG. 2.

Figure 6:
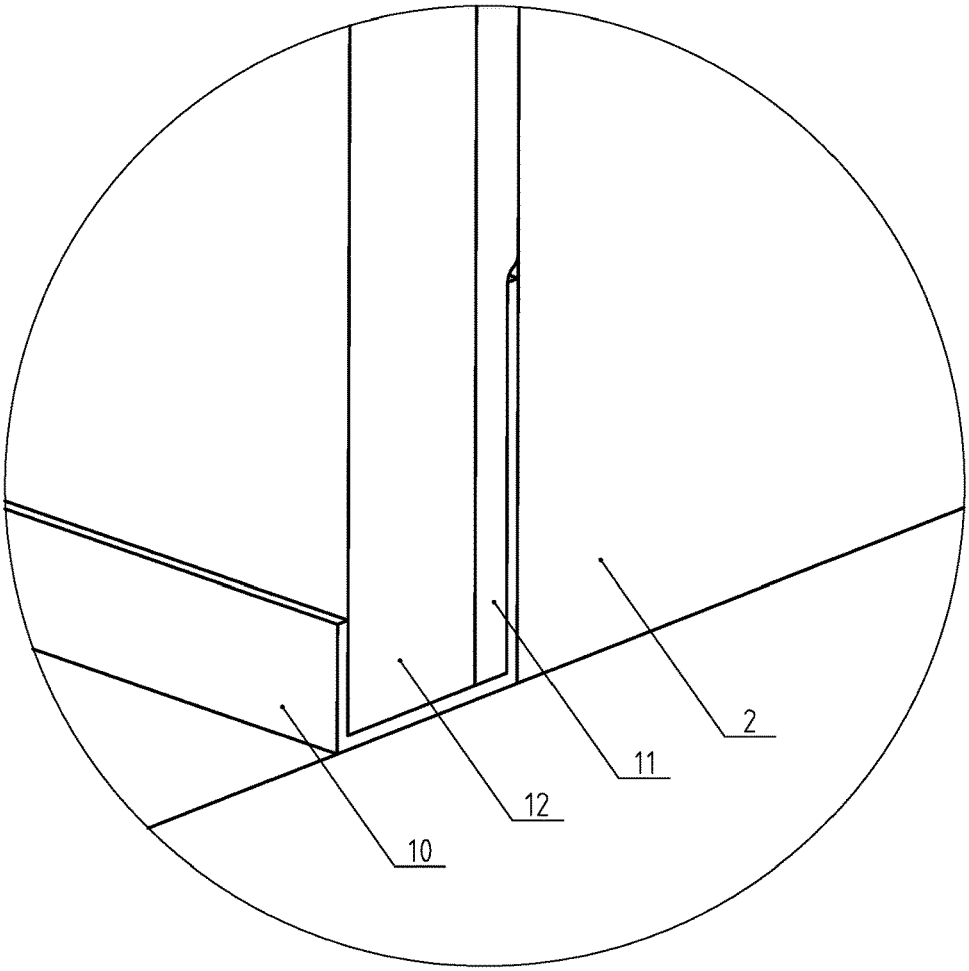
FIG. 6 is a partial view of part A in FIG. 1.
Figure 8:
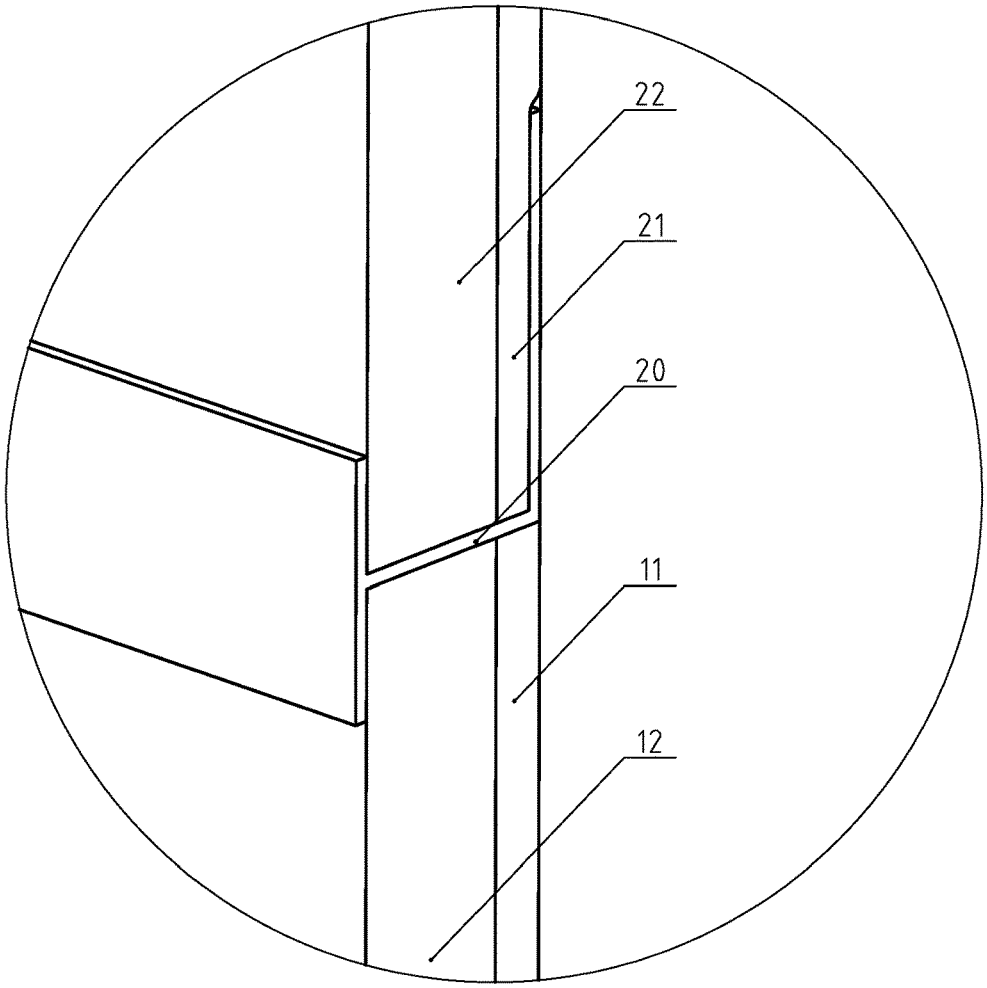
FIG. 8 is a partial view of part B in FIG. 1.

A10 placing a second expansion screw 23, the second trim strip 20 is fasten to the wall 2 by a cooperation of the second expansion screw 23 and a second expansion casing 24, remove the auxiliary tool as mentioned in step A8, at this point, the first tile 12 is assembled, as shown in FIG. 6 and FIG. 8, then steps for laying second tile 22*s* are performed.

A11 placing a second EPE foam 21, the second EPE foam 21 is arranged to appress the wall 2, a distance between the second EPE foam 21 and the sixth surface 28 of the second trim strip 20 is less than a thickness of the second tile 22 so as to provide a basis for an interference assembly of the second tile 22.

A12 placing the second tile 22, the second tile 22 is assembled between the sixth surface 28 of the second tile 22 and second EPE foam 21 in an interference way. Insert the second tile 22 diagonally into a space between the second EPE foam 21 and the sixth surface 28 of the second trim strip 20, and then temporarily fix the second tile 22 at current position with the auxiliary tool.

Figure 12:
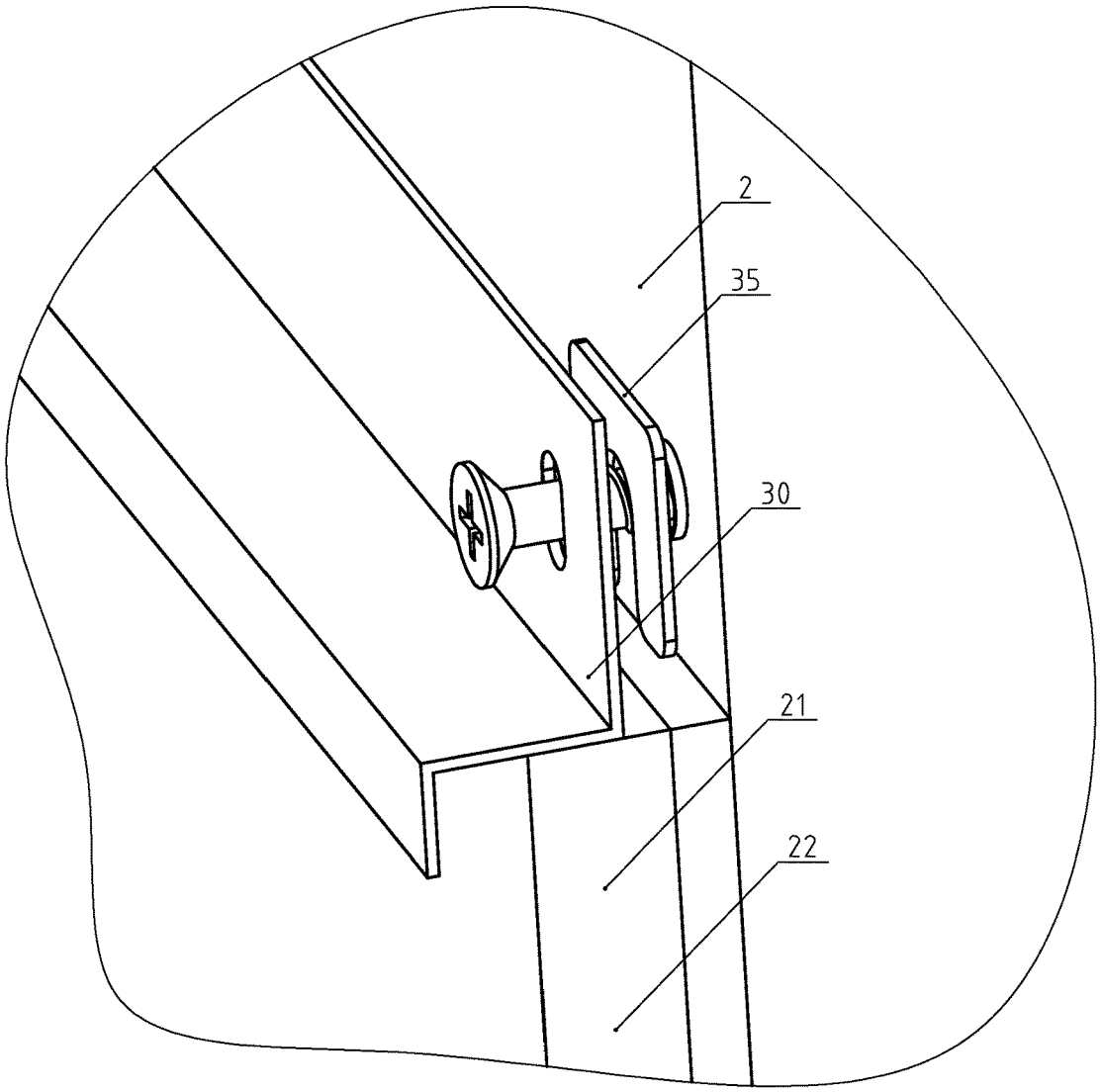
FIG. 12 is an partial exploded view of FIG. 1.

A13 placing and adjusting a third trim strip 30 to make a seventh surface 36 of the third trim strip 30 appress a third surface 18 of the second tile 22 and make an eighth surface 37 of the third trim strip 30 match the wall 2 and make a ninth surface 38 of the third trim strip 30 appress a fourth surface 26 of the second tile 22. The third surface 18 of the second tile 22 is defined as a side surface of the second tile 22 facing a ceiling after being assembled, the fourth surface 26 of the second tile 22 is defined as a front surface of the second tile 22. The laying method disclosed in the present embodiment can be implemented on a rough wall 2, because the rough wall 2 is unlevelled, there may be a space between the eighth surface 37 of the third trim strip 30 and the wall 2, the space can be filled by a third backing plate 35, in particular, a space at a mounting hole needs to be filled with the third backing plate 35, an overall thickness can be adjusted by combining multiple third backing plate 35*s* to fill different spaces, a vertical degree of the second tile 22 also can be adjusted at the same time, as shown in FIG. 12.

Figure 10:
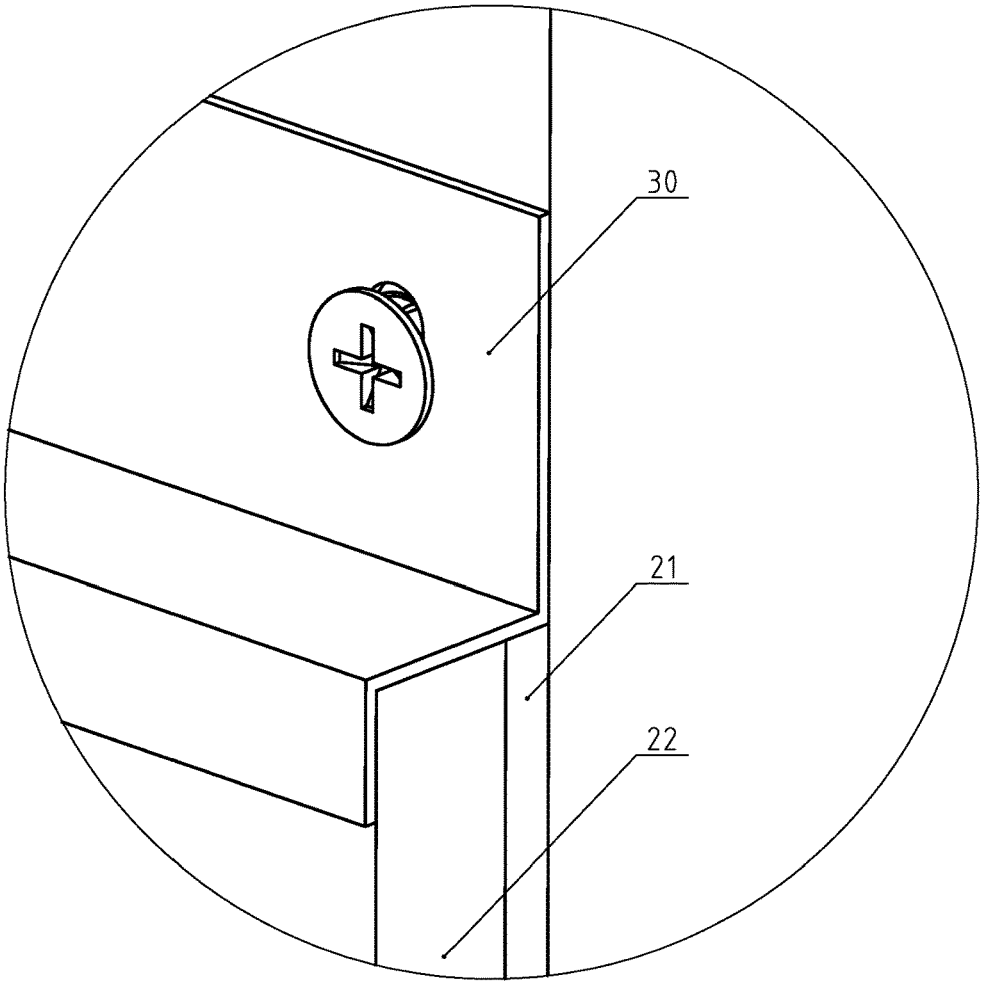
FIG. 10 is a partial view of part C in FIG. 1.

A14 placing a third expansion screw 33, the third trim strip 30 is fasten to the wall 2 by a cooperation of the third expansion screw 33 and a third expansion casing 34, remove the auxiliary tool as mentioned in step A12, at this point, the second tile 22 is assembled, as shown in FIG. 8 and FIG. 10, then steps for adjusting a relative flatness between the first tile 12 and the second tile 22 are performed.

Figure 16:
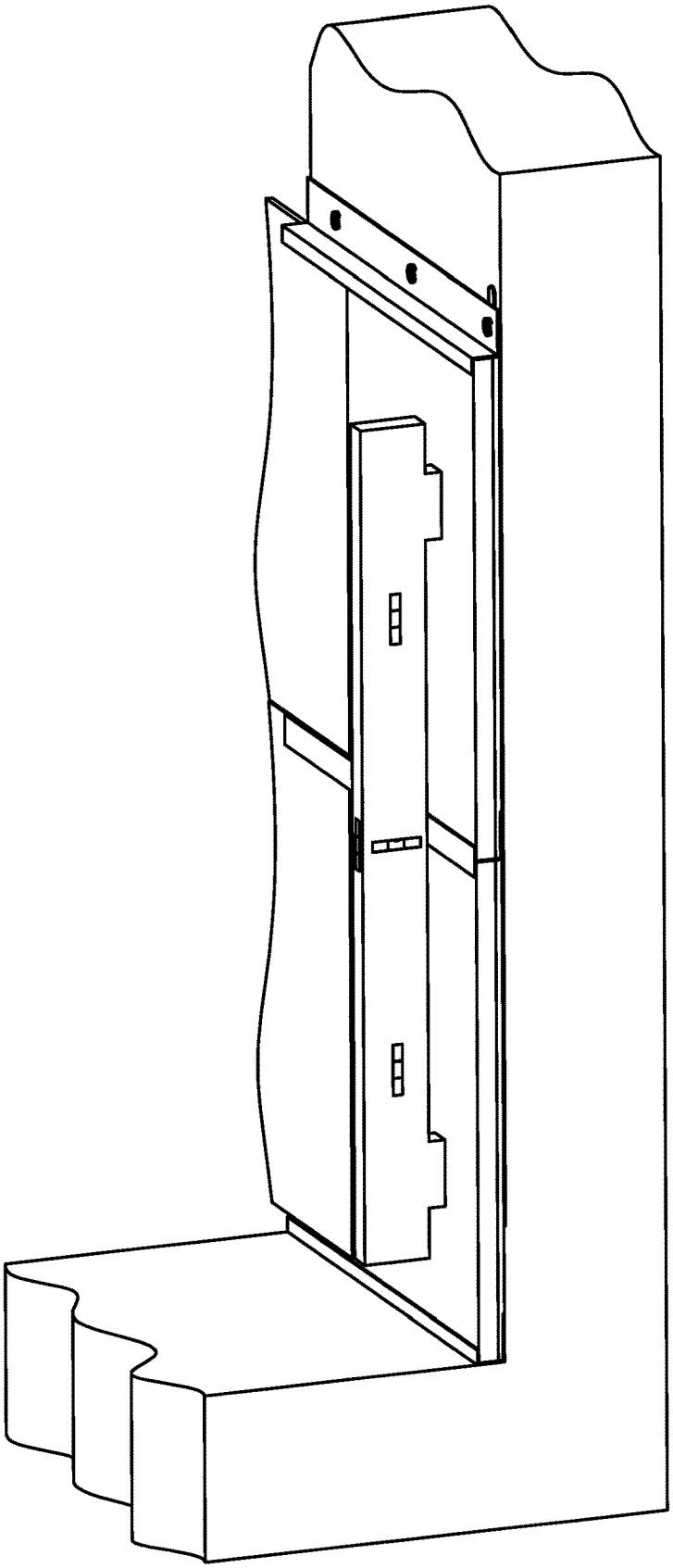
FIG. 16 is a drawing shows adjustment of flatness of tiles.

A15 the second surface 17 of the first tile 12 and the fourth surface 26 of the second tile 22 are located on a same vertical surface by adjusting the number of combinations of the third backing plate 35*s*, test surfaces at the two ends of a spirit level are respectively touch the first tile 12 and the second tile 22, and then the spirit level is placed vertically, a vertical state of the first tile 12 and second tile 22 is tested by observing the spirit level, as shown in FIG. 16.

Figure 7:
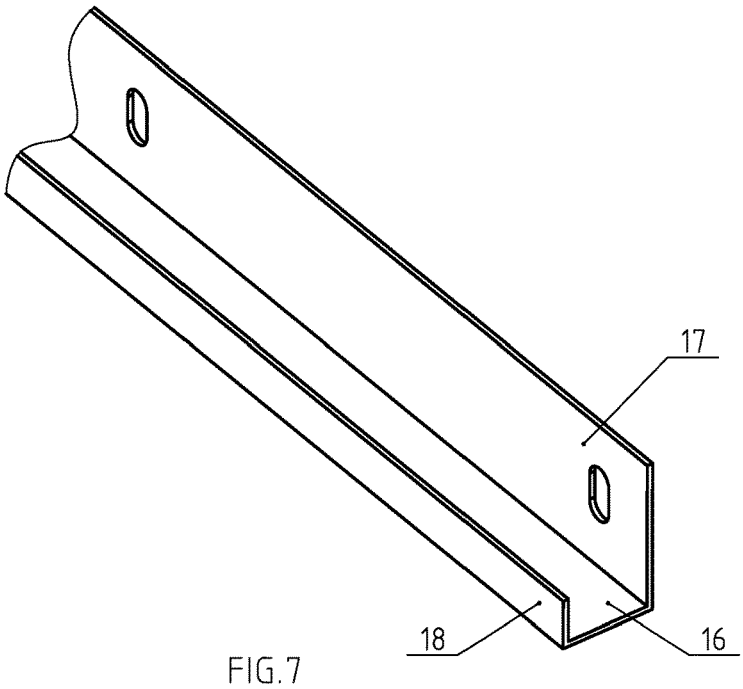
FIG. 7 is a perspective view of a first trim strip.

FIG. 7 shows the first trim strip 10 disclosed by the invention, the first trim strip 10 comprises the first surface 16, the second surface 17, and the third surface 18. The second surface 17 is parallel to the third surface 18, the first surface 16 is perpendicularly connected to the second surface 17 and the third surface 18, the second surface 17 and the third surface 18 are at the same side of the first surface 16, a plurality of first mounting hole are arranged to the second surface 17, a distance between each first mounting hole is consistent.

Figure 9:
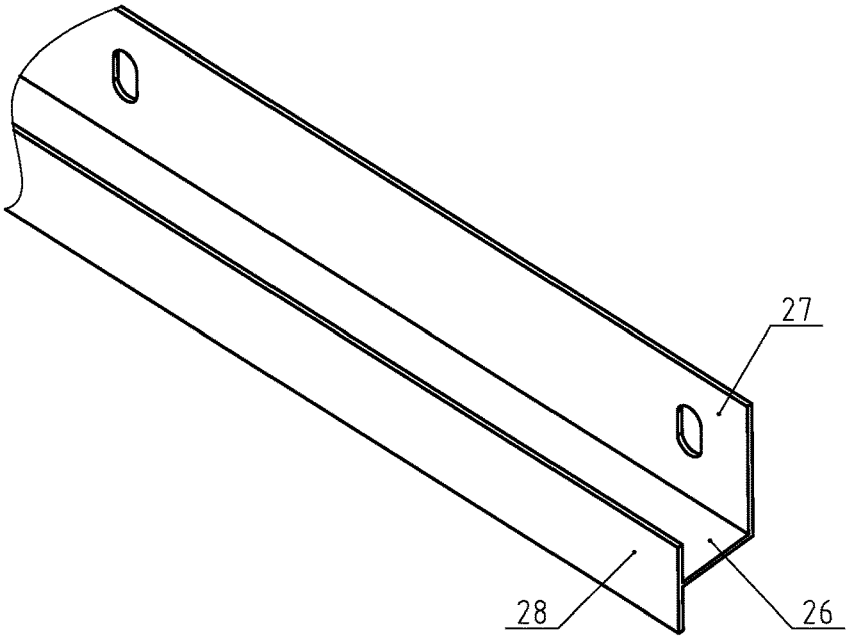
FIG. 9 is a perspective view of a second trim strip.

FIG. 9 shows the second trim strip 20 disclosed by the invention, the second trim strip 20 comprises the fourth surface 26, the fifth surface 27, and the sixth surface 28. The fifth surface 27 is parallel to the sixth surface 28, the fourth surface 26 is perpendicularly connected to a middle portion of the fifth surface 27, the fifth surface 27 is at one side of the fourth surface 26, a plurality of second mounting holes are arranged to the fifth surface 27, a distance between each second mounting hole is consistent.

Figure 11:
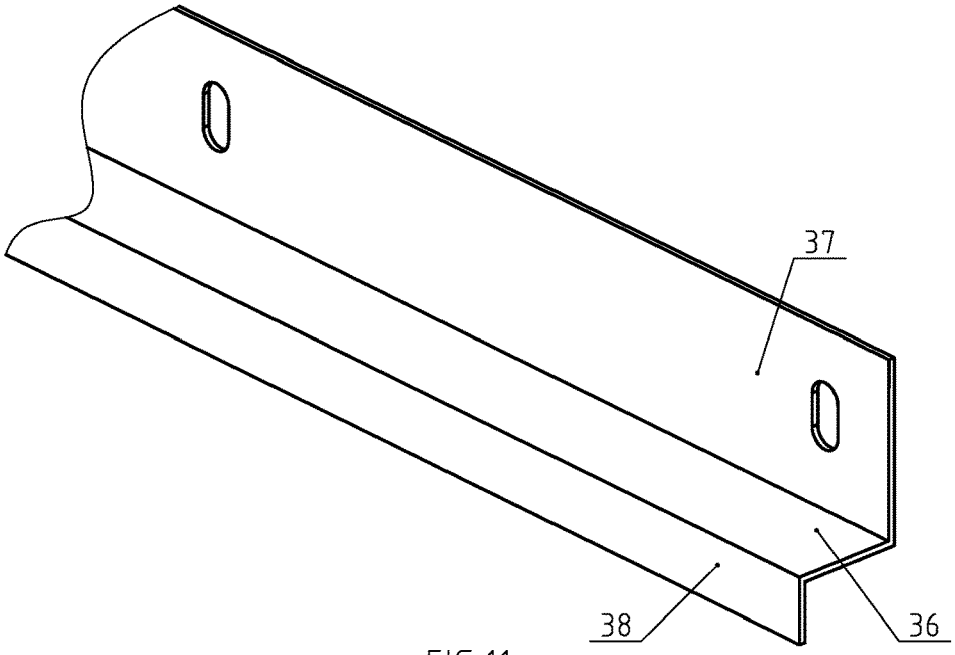
FIG. 11 is a perspective view of a third trim strip.

FIG. 11 shows the third trim strip 30 disclosed by the invention, the third trim strip 30 comprises the seventh surface 36, the eighth surface 37, and the ninth surface 38. The eighth surface 37 is parallel to the ninth surface 38, the seventh surface 36 is perpendicularly connected to the eighth surface 37 and the ninth surface 38, the eighth surface 37 and ninth surface 38 are at opposite side of the seventh surface 36, a plurality of third mounting hole are arranged to the eighth surface 37, a distance between each third mounting hole is consistent.

Figure 13:
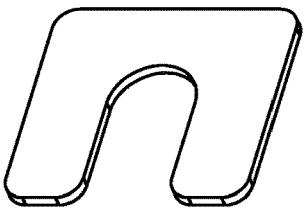
FIG. 13 is a perspective view of a backing plate.

FIG. 13 shows a kind of backing plate disclosed by the invention, the backing plate has a thin plate structure, a U-typed opening for inserting an expansion screw is arranged to one side of the backing plate, the backing plate has a thickness of 1 mm or 3 mm, this is good for making a combination of different thickness backing plate according to the unevenness of the rough wall 2 surface so as to fill a space between a trim strip and the rough wall 2, and to adjust a vertical state of tile at the same time.

Figure 14:
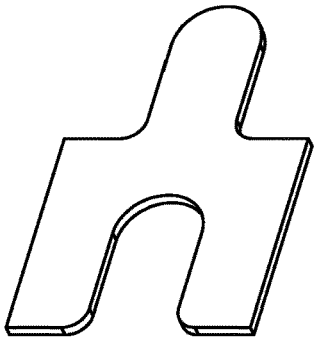
FIG. 14 is a perspective view of a backing plate of another embodiment.
Figure 15:
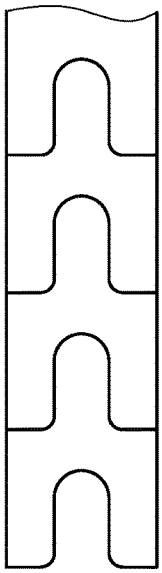
FIG. 15 is a drawing shows punching line of a backing plate of FIG. 14.

FIG. 14 shows another kind of backing plate disclosed by the invention, the backing plate has a thin plate structure, a U-typed opening for inserting an expansion screw is arranged to one side of the backing plate, a lug consistent with a shape of the U-typed opening is arranged to an opposite side of the U-typed opening, the lug is good for taking the backing plate during inserting the backing plate into a space between the trim strip and the wall 2, this structure is also good for arranging punching line when the die punches material, a utilization rate of materials is improved, which can make full use of the entire strip, as shown in FIG. 15.

Figure 18:
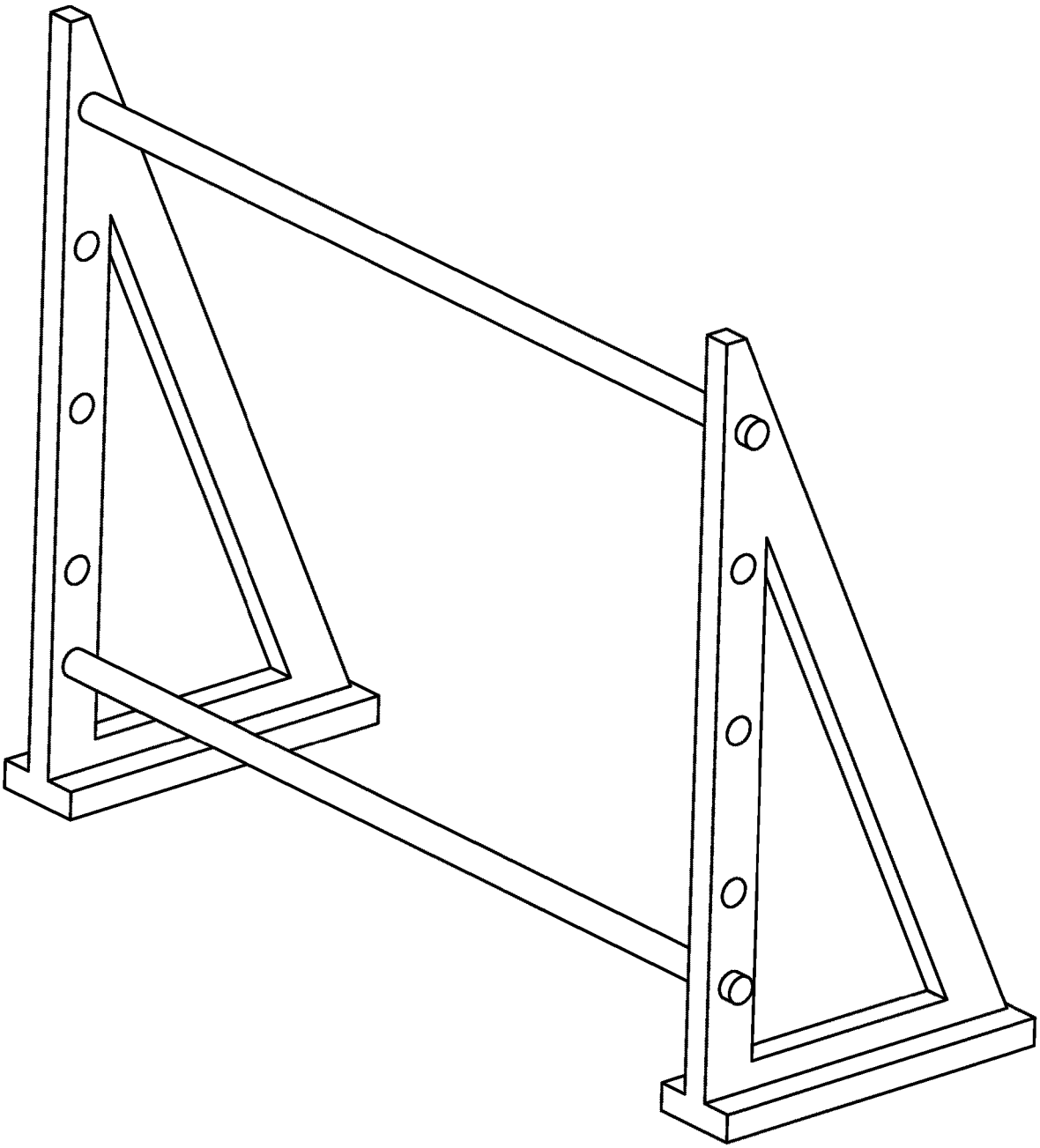
FIG. 18 is a perspective view of an auxiliary tool for temporarily mounting a wall cladding sheet.

FIG. 18 shows the auxiliary tool for temporary fixing of tile, the tool has a triangle bracket arranged to each side of the tool, a crossbar is connected with two triangle brackets, a distance between two crossbars can be adjusted according to a tile height, the crossbar is used to temporarily support the tiles and prevent them from falling over.

The laying method disclosed by the invention uses EPE foam instead of cement mortar, a thickness of the EPE foam is 5 mm, the tiles directly appress the EPE foam, so this laying method eliminates a cement mortar bonding layer having a thickness of 10 mm and reduces loss of use area indoors.

In traditional dry hanging method, there may be only a few 4 hanging points on the back of the tile, and the total contact surface is about 0.5%-1% of the area the entire back of the tile. When a front of the tile is impacted, the impact force is borne by the hanging point, and the hanging point has been cut out of a groove for installing a metal hook, and the metal hook and the tile are both rigid, so the hanging point is a load concentration point and a weak point of the entire tile. Therefore, when the tile is subjected to a certain impact, the tile may be easily broken at the hanging point. The invention discloses the laying method that the tile is intact without any cutting for groove, and that the EPE foam is laid behind the tile to provide a buffer layer between the tile and the wall 2, so the tile has no load concentration point, when a front of tile is hit, impact force is released to the EPE foam through the entire back of the tile. The load is balanced and there is no load concentration point, so the tile is not easy to break.

Since the EPE foam on the back of tile bears the load on the entire back of the tile, the larger the area of a single tile, the smaller the load on the unit area of EPE foam, and the smaller the deformation of the unit area on the EPE foam. That is, the less likely the tile is to be displaced in the direction of the normal phase of the tile surface. The hardness of the large tiles laid with EPE foam is as hard as that of large tile bonded with cement mortar after curing, but the weight of EPE foam is lighter than that of cement mortar.

Embodiment 2

Embodiment 2 discloses a laying method using modular assembly, wall 2 drilling is unified in early stage, and expansion screws are used in later stage.

The first trim strip 10 in Embodiment 1 is fastened to the ground 1 in Embodiment 2, an expansion casing is arranged to the ground 1 for fastening the first trim strip 10, so a fourth auxiliary line 6 is needed to arranged to the ground 1, steps for the laying method are as follows.

B1 placing a first auxiliary line 3 on the ground 1 to lay a tile along the first auxiliary line 3, the first auxiliary line 3 can be placed on the ground 1 in a method of elastic ink line.

B2 placing a second auxiliary line 4 on a wall 2 parallel to the first auxiliary line 3, the second auxiliary line 4 comprises a plurality of horizontal lines.

B3 placing a third auxiliary line 5 on the wall 2, the third auxiliary line 5 is vertical and comprising a plurality of vertical lines.

Figure 5:
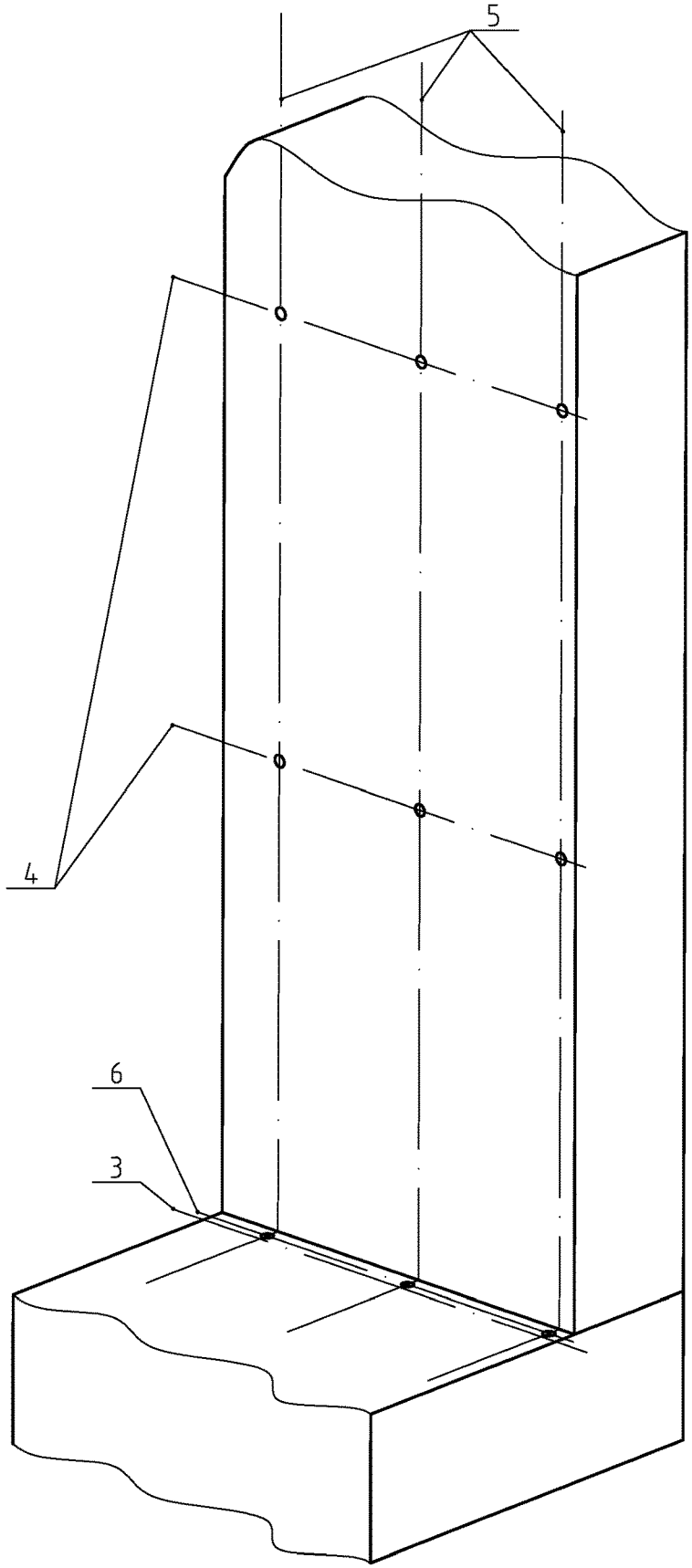
FIG. 5 is a layout of auxiliary line in Embodiment 2.

B4 placing a fourth auxiliary line 6 on the ground 1, the fourth auxiliary line 6 is parallel to the first auxiliary line 3, as shown in FIG. 5.

B5 drilling a mounting hole on the wall 2 at an intersection point of the second auxiliary line 4 and the third auxiliary line 5, and placing an expansion casing in the mounting hole to fasten a trim strip.

B6 drilling a mounting hole on the ground 1 at an intersection point of the fourth auxiliary line 6 and an extension line of the third auxiliary line 5 on the ground 1, and placing an expansion casing in the mounting hole to fasten a trim strip, as shown in FIG. 5.

B7 placing and adjusting a first trim strip 10 to make a first surface 16 of the first trim strip 10 appress the ground 1 and make a second surface 17 of the first trim strip 10 match the wall 2 and make a third surface 18 of the first trim strip 10 appress the first auxiliary line 3.

B8 drilling a hole on the ground 1 corresponding to a first mounting hole of the first trim strip 10 and placing a first expansion screw 13 in the hole, the first trim strip 10 is fastened to the ground 1 under a cooperation between the first expansion screw 13 and the first expansion casing 14.

Figure 17:
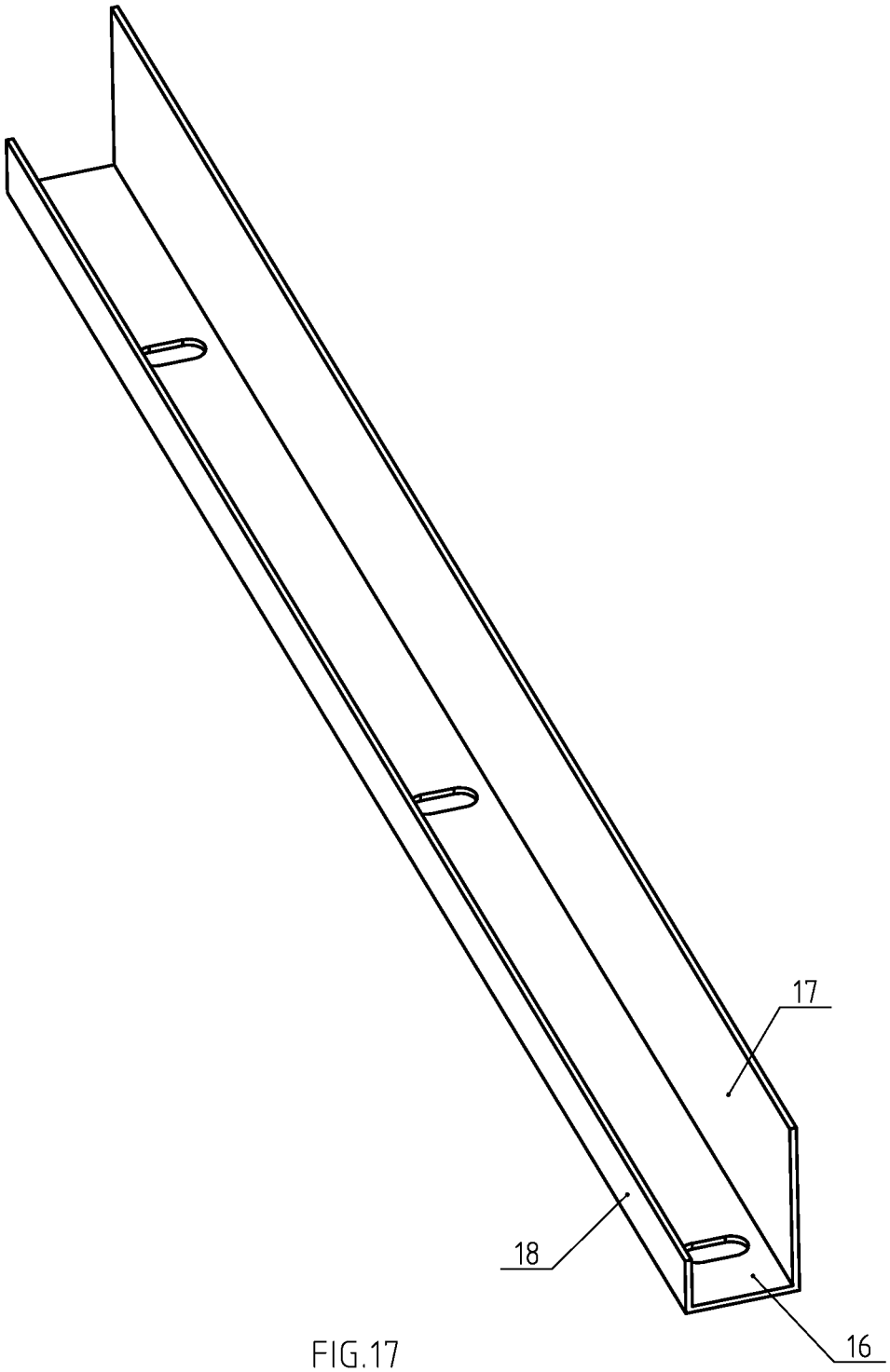
FIG. 17 is a perspective view of a first trim strip in Embodiment 2.

FIG. 17 shows the first trim strip 10 in Embodiment 2, the first trim strip 10 comprises a first surface 16, a second surface 17, and a third surface 18. The second surface 17 is parallel to the third surface 18, the first surface 16 is perpendicularly connected to the second surface 17 and the third surface 18, the second surface 17 and the third surface 18 are at the same side of the first surface 16, a first mounting hole is arranged to the first surface 16.

Embodiment 3

Embodiment 3 discloses a laying method that drilling and assembling are happened concurrently, this laying method is suitable for laying a wall 2 with small area, the laying method comprises steps as follows.

C1 placing an auxiliary line on a ground 1 to lay a tile along the auxiliary line, the auxiliary line can be placed on the ground 1 in a method of elastic ink line.

C2 placing and adjusting a first trim strip 10 to make a first surface 16 of the first trim strip 10 appress the ground 1 and make a second surface 17 of the first trim strip 10 match the wall 2 and make a third surface 18 of the first trim strip 10 appress the auxiliary line. The laying method disclosed in the present embodiment can be implemented on a rough wall 2, because the rough wall 2 is unlevelled, there may be a space between the second surface 17 of the first trim strip 10 and the wall 2, the space can be filled by a first backing plate 15, in particular, a space at a mounting hole needs to be filled with the first backing plate 15, an overall thickness can be adjusted by combining multiple first backing plate 15*s* to fill different spaces, as shown in FIG. 3.

C3 drilling a hole on the wall 2 corresponding to a first mounting hole of the first trim strip 10 and placing a first expansion screw 13 in the hole, the first trim strip 10 is fastened to the wall 2 under a cooperation between the first expansion screw 13 and a first expansion casing 14.

C4 placing a first EPE foam 11 to make the first PEP foam appress the wall 2, a distance between the first EPE foam 11 and the third surface 18 of the first trim strip 10 is less than a thickness of a first tile 12 so as to provide a basis for an interference assembly of the first tile 12.

C5 placing the first tile 12, the first tile 12 is assembled between the third surface 18 of the first trim strip 10 and the first EPE foam 11 in an interference way. Insert the first tile 12 diagonally into a space between the first EPE foam 11 and the third surface 18 of the first trim strip 10, and then temporarily fix the first tile 12 at current position with an auxiliary tool.

C6 placing and adjusting a second trim strip 20 to make a fourth surface 26 of the second trim strip 20 appress a first surface 16 of the first tile 12 and make a fifth surface 27 of the second trim strip 20 match the wall 2 and make a sixth surface 28 of the second trim strip 20 appress a second surface 17 of the first tile 12. The first surface 16 of the first tile 12 is defined as a side surface of the first tile 12 facing a ceiling after being assembled, the second surface 17 of the first tile 12 is defined as a front surface of the first tile 12. The laying method disclosed in the present embodiment can be implemented on a rough wall 2, because the rough wall 2 is unlevelled, there may be a space between the fifth surface 27 of the second trim strip 20 and the wall 2, the space can be filled by a second backing plate 25, in particular, a space at a mounting hole needs to be filled with the second backing plate 25, an overall thickness can be adjusted by combining multiple second backing plate 25*s* to fill different spaces, and to adjust a vertical state of the first tile 12 at the same time, as shown in FIG. 2.

C7 drilling a hole on the wall 2 corresponding to a second mounting hole of the second trim strip 20 and placing a second expansion screw 23 in the hole, the second trim strip 20 is fastened to the wall 2 under a cooperation of the second expansion screw 23, remove the auxiliary tool as mentioned in step C5, at this point, the first tile 12 is assembled, as shown in FIG. 6 and FIG. 8, then steps for laying second tile 22*s* are performed.

C8 placing a second EPE foam 21 to make the second EPE foam 21 appress the wall 2, a distance between the second EPE foam 21 and the sixth surface 28 of the second trim strip 20 is less than a thickness of the second wall cladding sheet to provide a basis for an interference assembly of the second tile 22.

C9 placing the second tile 22, the second tile 22 is assembled between the sixth surface 28 of the second tile 22 and the second EPE foam 21 in an interference way. Insert the second tile 22 diagonally into a space between the second EPE foam 21 and the sixth surface 28 of the second trim strip 20, and then temporarily fix the second tile 22 at current position with the auxiliary tool.

C10 placing and adjusting a third trim strip 30 to make a seventh surface 36 of the third trim strip 30 appress a third surface 18 of the second tile 22 and make an eighth surface 37 of the third trim strip 30 match the wall 2 and make a ninth surface 38 of the third trim strip 30 appress a fourth surface 26 of the second tile 22. The third surface 18 of the second tile 22 is defined as a side surface of the second tile 22 facing a ceiling after being assembled, the fourth surface 26 of the second tile 22 is defined as a front surface of the second tile 22. The laying method disclosed in the present embodiment can be implemented on a rough wall 2, because the rough wall 2 is unlevelled, there may be a space between the eighth surface 37 of the third trim strip 30 and the wall 2, the space can be filled by a third backing plate 35, in particular, a space at a mounting hole needs to be filled with the third backing plate 35, an overall thickness can be adjusted by combining multiple third backing plate 35*s* to fill different spaces, and to adjust a vertical state of the second tile 22 at the same time, as shown in FIG. 12.

C11 drilling a hole on the wall 2 corresponding to a third mounting hole of the third trim strip 30 and placing a third expansion screw 33 in the hole, the third trim strip 30 being fastened to the wall 2 under a cooperation of the third expansion screw 33. Remove the auxiliary tool as mentioned in step C9, at this point, the second tile 22 is assembled, as shown in FIG. 8 and FIG. 10, then steps for adjusting a relative flatness between the first tile 12 and the second tile 22 are performed.

The second surface 17 of the first tile 12 and the fourth surface 26 of the second tile 22 are located on a same vertical surface by adjusting the number of combinations of the third backing plate 35*s*, test surfaces at the two ends of a spirit level are respectively touch the first tile 12 and the second tile 22, and then the spirit level is placed vertically, a vertical state of the first tile 12 and second tile 22 is tested by observing the spirit level, as shown in FIG. 16.

Embodiment 4

Embodiment 4 discloses a laying method that drilling and assembling are happened concurrently, this laying method is suitable for laying a wall 2 with small area. The first trim strip 10 in Embodiment 3 is fastened to the ground 1 in Embodiment 4, an expansion casing is arranged to the ground 1 for fastening the first trim strip 10, steps for the laying method are as follows.

D1 placing an auxiliary line on the ground 1 to lay a tile along the auxiliary line, the auxiliary line can be placed on the ground 1 in a method of elastic ink line.

D2 placing and adjusting a first trim strip 10 to make a first surface 16 of the first trim strip 10 appress the ground 1 and make a second surface 17 of the first trim strip 10 match the wall 2 and make a third surface 18 of the first trim strip 10 appress the auxiliary line. The laying method disclosed in the present embodiment can be implemented on a rough wall 2, because the rough wall 2 is unlevelled, there may be a space between the second surface 17 of the first trim strip 10 and the wall 2, the space can be filled by a first backing plate 15, in particular, a space at a mounting hole needs to be filled with the first backing plate 15, an overall thickness can be adjusted by combining multiple first backing plate 15*s* to fill different spaces, as shown in FIG. 3.

D3 drilling a hole on the ground 1 corresponding to a first mounting hole of the first trim strip 10 and placing a first expansion screw 13 in the hole, the first trim strip 10 being fastened to the ground 1 by the first expansion screw 13.

D4 placing a first EPE foam 11 to make the first PEP foam appress the wall 2, a distance between the first EPE foam 11 and the third surface 18 of the first trim strip 10 being less than a thickness of a first tile 12 to provide a basis for an interference assembly of the first tile 12.

D5 placing the first tile 12, the first tile 12 is assembled between the third surface 18 of the first trim strip 10 and the first EPE foam 11 in an interference way. Insert the first tile 12 diagonally into a space between the first EPE foam 11 and the third surface 18 of the first trim strip 10, and then temporarily fix the first tile 12 at current position with an auxiliary tool.

D6 placing and adjusting a second trim strip 20 to make a fourth surface 26 of the second trim strip 20 appress a first surface 16 of the first tile 12 and make a fifth surface 27 of the second trim strip 20 match the wall 2 and make a sixth surface 28 of the second trim strip 20 appress a second surface 17 of the first tile 12. The first surface 16 of the first tile 12 is defined as a side surface of the first tile 12 facing a ceiling after being assembled, the second surface 17 of the first tile 12 is defined as a front surface of the first tile 12. The laying method disclosed in the present embodiment can be implemented on a rough wall 2, because the rough wall 2 is unlevelled, there may be a space between the fifth surface 27 of the second trim strip 20 and the wall 2, the space can be filled by a second backing plate 25, in particular, a space at a mounting hole needs to be filled with the second backing plate 25, an overall thickness can be adjusted by combining multiple second backing plate 25*s* to fill different spaces, and to adjust a vertical state of the first tile 12 at the same time, as shown in FIG. 2.

D7 drilling a hole on the wall 2 corresponding to a second mounting hole of the second trim strip 20 and placing a second expansion screw 23 in the hole, the second trim strip 20 is fastened to the wall 2 by the second expansion screw 23. Remove the auxiliary tool as mentioned in step D5, at this point, the first tile 12 is assembled, as shown in FIG. 6 and FIG. 8, then steps for laying a second tile 22 are performed.

D8 placing a second EPE foam 21 to make the second EPE foam 21 appress the wall 2, a distance between the second EPE foam 21 and the sixth surface 28 of the second trim strip 20 is less than a thickness of the second tile 22 to provide a basis for an interference assembly of the second tile 22.

D9 placing the second tile 22, the second tile 22 is assembled between the sixth surface 28 of the second tile 22 and second EPE foam 21 in an interference way. Insert the second tile 22 diagonally into a space between the second EPE foam 21 and the sixth surface 28 of the second trim strip 20, and then temporarily fix the second tile 22 at current position with the auxiliary tool.

D10 placing and adjusting a third trim strip 30 to make a seventh surface 36 of the third trim strip 30 appress a third surface 18 of the second tile 22 and make an eighth surface 37 of the third trim strip 30 match the wall 2 and make a ninth surface 38 of the third trim strip 30 appress a fourth surface 26 of the second tile 22. The third surface 18 of the second tile 22 is defined as a side surface of the second tile 22 facing a ceiling after being assembled, the fourth surface 26 of the second tile 22 is defined as a front surface of the second tile 22. The laying method disclosed in the present embodiment can be implemented on a rough wall 2, because the rough wall 2 is unlevelled, there may be a space between the eighth surface 37 of the third trim strip 30 and the wall 2, the space can be filled by a third backing plate 35, in particular, a space at a mounting hole needs to be filled with the third backing plate 35, an overall thickness can be adjusted by combining multiple third backing plate 35*s* to fill different spaces, and to adjust a vertical state of the second tile 22 at the same time, as shown in FIG. 12.

D11 drilling a hole on the wall 2 corresponding to a third mounting hole of the third trim strip 30 and placing a third expansion screw 33 in the hole, the third trim strip 30 is fastened to the wall 2 by the third expansion screw 33. Remove the auxiliary tool as mentioned in step D9, at this point, the second tile 22 is assembled, as shown in FIG. 8 and FIG. 10, then steps for adjusting a relative flatness between the first tile 12 and the second tile 22 are performed.

The second surface 17 of the first tile 12 and the fourth surface 26 of the second tile 22 are located on a same vertical surface by adjusting the number of combinations of the third backing plate 35*s*, test surfaces at the two ends of a spirit level are respectively touch the first tile 12 and the second tile 22, and then the spirit level is placed vertically, a vertical state of the first tile 12 and second tile 22 is tested by observing the spirit level, as shown in FIG. 16.

FIG. 17 shows the first trim strip 10 disclosed by the Embodiment 4, the first trim strip 10 comprises the first surface 16, the second surface 17, and the third surface 18. The second surface 17 is parallel to the third surface 18, the first surface 16 is perpendicularly connected to the second surface 17 and the third surface 18, the second surface 17 and the third surface 18 are at the same side of the first surface 16, a plurality of first mounting hole are arranged to the first surface 16, a distance between each first mounting hole is consistent.

The invention claimed is:

1. A method for laying wall cladding sheet comprises steps:

A1 placing a first auxiliary line (3) on a ground (1) to lay a wall cladding sheet along the first auxiliary line (3);

A2 placing a second auxiliary line (4) on a wall (2) parallel to the first auxiliary line (3), the second auxiliary line (4) comprising a plurality of horizontal lines;

A3 placing a third auxiliary line (5) on the wall (2), the third auxiliary line (5) being vertical and comprising a plurality of vertical lines;

A4 drilling a mounting hole on the wall (2) at an intersection point of the second auxiliary line (4) and the third auxiliary line (5), placing an expansion casing in the mounting hole to fasten a trim strip;

A5 placing and adjusting a first trim strip (10) to make a first surface (16) of the first trim strip (10) appress the ground (1) and make a second surface (17) of the first trim strip (10) match the wall (2) and make a third surface (18) of the first trim strip (10) appress the first auxiliary line (3);

A6 placing a first expansion screw (13) to fasten the first trim strip (10) to the wall (2) under a cooperation of the first expansion casing (14);

A7 placing a first EPE foam (11) to make the first PEP foam appress the wall (2), a distance between the first EPE foam (11) and the third surface (18) of the first trim strip (10) being less than a thickness of a first wall cladding sheet (12);

A8 placing the first wall cladding sheet (12), the first wall cladding sheet (12) being assembled between the third surface (18) of the first trim strip (10) and the first EPE foam (11) in an interference way;

A9 placing and adjusting a second trim strip (20) to make a fourth surface (26) of the second trim strip (20) appress a first surface (16) of the first wall cladding sheet (12) and make a fifth surface (27) of the second trim strip (20) match the wall (2) and make a sixth surface (28) of the second trim strip (20) appress a second surface (17) of the first wall cladding sheet (12);

A10 placing a second expansion screw (23) to fasten the second trim strip (20) to the wall (2) under a cooperation of a second expansion casing (24);

A11 placing a second EPE foam (21) to make the second EPE foam (21) appress the wall (2), a distance between the second EPE foam (21) and the sixth surface (28) of the second trim strip (20) being less than a thickness of the second wall cladding sheet (22);

A12 placing the second wall cladding sheet (22), the second wall cladding sheet (22) being assembled between the sixth surface (28) of the second wall cladding sheet (22) and second EPE foam (21) in an interference way;

A13 placing and adjusting a third trim strip (30) to make a seventh surface (36) of the third trim strip (30) appress a third surface (18) of the second wall cladding sheet (22) and make an eighth surface (37) of the third trim strip (30) match the wall (2) and make a ninth surface (38) of the third trim strip (30) appress a fourth surface (26) of the second wall cladding sheet (22);

A14 placing a third expansion screw (33) to fasten the third trim strip (30) to the wall (2) under a cooperation of a third expansion casing (34).

2. The method for laying wall cladding sheet according to claim 1, wherein A5 comprising filling a space between the second surface (17) of the first trim strip (10) and the wall (2) with a first backing plate (15);

A9 comprising filling a space between the fifth surface (27) of the second trim strip (20) and the wall (2) with a second backing plate (25);

A13 comprising filling a space between the eighth surface (37) of the third trim strip (30) and the wall (2) with a third backing plate (35).

3. The method for laying wall cladding sheet according to claim 2, wherein a vertical alignment that the second surface (17) of the first wall cladding sheet (12) and the fourth surface (26) of the second wall cladding sheet (22) are on a same vertical plane by adjusting the third backing plate (35) is arranged.

4. The method for laying wall cladding sheet according to claim 3, wherein the first wall cladding sheet (12) comprises a natural stone, or an artificial stone, or a ceramic tile, the second wall cladding sheet (22) comprising a natural stone, or an artificial stone, or a ceramic tile.

5. The method for laying wall cladding sheet according to claim 1, wherein the first trim strip (10) comprising the first surface (16), the second surface (17), and the third surface (18), the second surface (17) being parallel to the third surface (18), the first surface (16) being perpendicularly connected to the second surface (17) and the third surface (18), the second surface (17) and the third surface (18) being at the same side of the first surface (16), a first mounting hole being arranged to the second surface (17);

the second trim strip (20) comprising the fourth surface (26), the fifth surface (27), and the sixth surface (28), the fifth surface (27) being parallel to the sixth surface (28), the fourth surface (26) being perpendicularly connected to a middle portion of the fifth surface (27), the fifth surface (27) being at one side of the fourth surface (26), a second mounting hole being arranged to the fifth surface (27);

the third trim strip (30) comprising the seventh surface (36), the eighth surface (37), and the ninth surface (38), the eighth surface (37) being parallel to the ninth surface (38), the seventh surface (36) being perpendicularly connected to the eighth surface (37) and the ninth surface (38), the eighth surface (37) and ninth surface (38) being at opposite side of the seventh surface (36), a third mounting hole being arranged to the eighth surface (37).

6. A method for laying wall cladding sheet comprises steps:

B1 placing a first auxiliary line (3) on a ground (1) to lay a wall cladding sheet along the first auxiliary line (3);

B2 placing a second auxiliary line (4) on a wall (2) parallel to the first auxiliary line (3), the second auxiliary line (4) comprising a plurality of horizontal lines;

B3 placing a third auxiliary line (5) on the wall (2), the third auxiliary line (5) being vertical and comprising a plurality of vertical lines;

B4 placing a fourth auxiliary line (6) on the ground (1), the fourth auxiliary line (6) being parallel to the first auxiliary line (3);

B5 drilling a mounting hole on the wall (2) at an intersection point of the second auxiliary line (4) and the third auxiliary line (5), placing an expansion casing in the mounting hole to fasten a trim strip;

B6 drilling a mounting hole on the ground (1) at an intersection point of the fourth auxiliary line (6) and an extension line of the third auxiliary line (5) on the ground (1), placing an expansion casing in the mounting hole to fasten a trim strip;

B7 placing and adjusting a first trim strip (10) to make a first surface (16) of the first trim strip (10) appress the ground (1) and make a second surface (17) of the first trim strip (10) match the wall (2) and make a third surface (18) of the first trim strip (10) appress the first auxiliary line (3);

B8 drilling a hole on the ground (1) corresponding to a first mounting hole of the first trim strip (10) and placing a first expansion screw (13) in the hole, the first trim strip (10) being fastened to the ground (1) under a cooperation between the first expansion screw (13) and a first expansion casing (14);

B9 placing a first EPE foam (11) to make the first PEP foam appress the wall (2), a distance between the first EPE foam (11) and the third surface (18) of the first trim strip (10) being less than a thickness of a first wall cladding sheet (12);

B10 placing the first wall cladding sheet (12), the first wall cladding sheet (12) being assembled between the third surface (18) of the first trim strip (10) and the first EPE foam (11) in an interference way;

B11 placing and adjusting a second trim strip (20) to make a fourth surface (26) of the second trim strip (20) appress a first surface (16) of the first wall cladding sheet (12) and make a fifth surface (27) of the second trim strip (20) match the wall (2) and make a sixth surface (28) of the second trim strip (20) appress a second surface (17) of the first wall cladding sheet (12);

B12 placing a second expansion screw (23) to fasten the second trim strip (20) to the wall (2) under a cooperation of a second expansion casing (24);

B13 placing a second EPE foam (21) to make the second EPE foam (21) appress the wall (2), a distance between the second EPE foam (21) and the sixth surface (28) of the second trim strip (20) being less than a thickness of the second wall cladding sheet (22);

B14 placing the second wall cladding sheet (22), the second wall cladding sheet (22) being assembled between the sixth surface (28) of the second wall cladding sheet (22) and second EPE foam (21) in an interference way;

B15 placing and adjusting a third trim strip (30) to make a seventh surface (36) of the third trim strip (30) appress a third surface (18) of the second wall cladding sheet (22) and make an eighth surface (37) of the third trim strip (30) match the wall (2) and make a ninth surface (38) of the third trim strip (30) appress a fourth surface (26) of the second wall cladding sheet (22);

B16 placing a third expansion screw (33) to fasten the third trim strip (30) to the wall (2) under a cooperation of a third expansion casing (34).

7. The method for laying wall cladding sheet according to claim 6, wherein B7 comprising filling a space between the second surface (17) of the first trim strip (10) and the wall (2) with a first backing plate (15);

B11 comprising filling a space between the fifth surface (27) of the second trim strip (20) and the wall (2) with a second backing plate (25);

B15 comprising filling a space between the eighth surface (37) of the third trim strip (30) and the wall (2) with a third backing plate (35).

8. The method for laying wall cladding sheet according to claim 7, wherein a vertical alignment that the second surface (17) of the first wall cladding sheet (12) and the fourth surface (26) of the second wall cladding sheet (22) are on a same vertical plane by adjusting the third backing plate (35) is arranged.

9. The method for laying wall cladding sheet according to claim 8, wherein the first wall cladding sheet (12) comprises a natural stone, or an artificial stone, or a ceramic tile, the second wall cladding sheet (22) comprising a natural stone, or an artificial stone, or a ceramic tile.

10. The method for laying wall cladding sheet according to claim 6, wherein the first trim strip (10) comprising the first surface (16), the second surface (17), and the third surface (18), the second surface (17) being parallel to the third surface (18), the first surface (16) being perpendicularly connected to the second surface (17) and the third surface (18), the second surface (17) and the third surface (18) being at the same side of the first surface (16), a first mounting hole being arranged to the first surface (16);

the second trim strip (20) comprising the fourth surface (26), the fifth surface (27), and the sixth surface (28), the fifth surface (27) being parallel to the sixth surface (28), the fourth surface (26) being perpendicularly connected to a middle portion of the fifth surface (27), the fifth surface (27) being at one side of the fourth surface (26), a second mounting hole being arranged to the fifth surface (27);

the third trim strip (30) comprising the seventh surface (36), the eighth surface (37), and the ninth surface (38), the eighth surface (37) being parallel to the ninth surface (38), the seventh surface (36) being perpendicularly connected to the eighth surface (37) and the ninth surface (38), the eighth surface (37) and ninth surface (38) being at opposite side of the seventh surface (36), a third mounting hole being arranged to the eighth surface (37).

11. A method for laying wall cladding sheet comprises steps:

C1 placing an auxiliary line on a ground (1) to lay a wall cladding sheet along the auxiliary line;

C2 placing and adjusting a first trim strip (10) to make a first surface (16) of the first trim strip (10) appress the ground (1) and make a second surface (17) of the first trim strip (10) match the wall (2) and make a third surface (18) of the first trim strip (10) appress the auxiliary line;

C3 drilling a hole on the wall (2) corresponding to a first mounting hole of the first trim strip (10) and placing a first expansion screw (13) in the hole, the first trim strip (10) being fastened to the wall (2) under a cooperation between the first expansion screw (13) and a first expansion casing (14);

C4 placing a first EPE foam (11) to make the first PEP foam appress the wall (2), a distance between the first EPE foam (11) and the third surface (18) of the first trim strip (10) being less than a thickness of a first wall cladding sheet (12);

C5 placing the first wall cladding sheet (12), the first wall cladding sheet (12) being assembled between the third surface (18) of the first trim strip (10) and the first EPE foam (11) in an interference way;

C6 placing and adjusting a second trim strip (20) to make a fourth surface (26) of the second trim strip (20) appress a first surface (16) of the first wall cladding sheet (12) and make a fifth surface (27) of the second trim strip (20) match the wall (2) and make a sixth surface (28) of the second trim strip (20) appress a second surface (17) of the first wall cladding sheet (12);

C7 drilling a hole on the wall (2) corresponding to a second mounting hole of the second trim strip (20) and placing a second expansion screw (23) in the hole, the second trim strip (20) being fastened to the wall (2) under a cooperation of the second expansion screw (23);

C8 placing a second EPE foam (21) to make the second EPE foam (21) appress the wall (2), a distance between the second EPE foam (21) and the sixth surface (28) of the second trim strip (20) being less than a thickness of the second wall cladding sheet (22);

C9 placing the second wall cladding sheet (22), the second wall cladding sheet (22) being assembled between the sixth surface (28) of the second wall cladding sheet (22) and the second EPE foam (21) in an interference way;

C10 placing and adjusting a third trim strip (30) to make a seventh surface (36) of the third trim strip (30) appress a third surface (18) of the second wall cladding sheet (22) and make an eighth surface (37) of the third trim strip (30) match the wall (2) and make a ninth surface (38) of the third trim strip (30) appress a fourth surface (26) of the second wall cladding sheet (22);

C11 drilling a hole on the wall (2) corresponding to a third mounting hole of the third trim strip (30) and placing a third expansion screw (33) in the hole, the third trim strip (30) being fastened to the wall (2) under a cooperation of the third expansion screw (33).

12. The method for laying wall cladding sheet according to claim 11, wherein C2 comprising filling a space between the second surface (17) of the first trim strip (10) and the wall (2) with a first backing plate (15);

C6 comprising filling a space between the fifth surface (27) of the second trim strip (20) and the wall (2) with a second backing plate (25);

C10 comprising filling a space between the eighth surface (37) of the third trim strip (30) and the wall (2) with a third backing plate (35).

13. The method for laying wall cladding sheet according to claim 12, wherein a vertical alignment that the second surface (17) of the first wall cladding sheet (12) and the fourth surface (26) of the second wall cladding sheet (22) are on a same vertical plane by adjusting the third backing plate (35) is arranged.

14. The method for laying wall cladding sheet according to claim 13, wherein the first wall cladding sheet (12) comprises a natural stone, or an artificial stone, or a ceramic tile, the second wall cladding sheet (22) comprising a natural stone, or an artificial stone, or a ceramic tile.

15. The method for laying wall cladding sheet according to claim 11, wherein the first trim strip (10) comprising the first surface (16), the second surface (17), and the third surface (18), the second surface (17) being parallel to the third surface (18), the first surface (16) being perpendicularly connected to the second surface (17) and the third surface (18), the second surface (17) and the third surface (18) being at the same side of the first surface (16), a first mounting hole being arranged to the second surface (17);

the second trim strip (20) comprising the fourth surface (26), the fifth surface (27), and the sixth surface (28), the fifth surface (27) being parallel to the sixth surface (28), the fourth surface (26) being perpendicularly connected to a middle portion of the fifth surface (27), the fifth surface (27) being at one side of the fourth surface (26), a second mounting hole being arranged to the fifth surface (27);

the third trim strip (30) comprising the seventh surface (36), the eighth surface (37), and the ninth surface (38), the eighth surface (37) being parallel to the ninth surface (38), the seventh surface (36) being perpendicularly connected to the eighth surface (37) and the ninth surface (38), the eighth surface (37) and ninth surface (38) being at opposite side of the seventh surface (36), a third mounting hole being arranged to the eighth surface (37).

* * * * *